US008929775B2

(12) United States Patent
Ito

(10) Patent No.: US 8,929,775 B2
(45) Date of Patent: Jan. 6, 2015

(54) BELT DRIVE DEVICE AND IMAGE FORMING APPARATUS

(75) Inventor: Yukifumi Ito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 480 days.

(21) Appl. No.: 12/923,287

(22) Filed: Sep. 13, 2010

(65) Prior Publication Data

US 2011/0069981 A1 Mar. 24, 2011

(30) Foreign Application Priority Data

Sep. 14, 2009 (JP) ..... 2009-211812

(51) Int. Cl.
*G03G 15/00* (2006.01)
*G03G 15/01* (2006.01)

(52) U.S. Cl.
CPC ..... *G03G 15/5054* (2013.01); *G03G 15/0131* (2013.01); *G03G 2215/0141* (2013.01); *G03G 2215/0158* (2013.01)
USPC ..... 399/165; 399/302; 399/303

(58) Field of Classification Search
CPC ..... G03G 15/5054; G03G 2215/00139; G03G 2215/00156
USPC ..... 399/49, 165
See application file for complete search history.

(56) References Cited

U.S. PATENT DOCUMENTS

| | | | | |
|---|---|---|---|---|
| 5,629,760 | A * | 5/1997 | Hayashi et al. | 399/312 |
| 5,732,312 | A * | 3/1998 | Takekoshi et al. | 399/160 |
| 6,134,399 | A * | 10/2000 | Hino et al. | 399/66 |
| 2001/0022907 | A1 * | 9/2001 | Fukao et al. | 399/302 |
| 2007/0183818 | A1 * | 8/2007 | Kakehi | 399/302 |

FOREIGN PATENT DOCUMENTS

| | | | |
|---|---|---|---|
| JP | 11/212426 | A | 8/1999 |
| JP | 2004-258281 | A | 9/2004 |
| JP | 2007-310010 | A | 11/2007 |
| JP | 2008-070619 | A | 3/2008 |

OTHER PUBLICATIONS

Machine translation of JP2009-070619.*

* cited by examiner

*Primary Examiner* — David Gray
*Assistant Examiner* — Andrew V Do
(74) *Attorney, Agent, or Firm* — Rabin & Berdo, P.C.

(57) ABSTRACT

A belt drive device for an image forming apparatus includes a belt, a roller, a roller drive member, a state detector and a controller. The roller drive member drives the roller that entrains the belt. The state detector detects a state of the belt. The controller identifies a specific portion of the belt based on the state detected by the state detector, and controls the roller drive member to stop the belt so that the specific portion lies at a predetermined position.

2 Claims, 15 Drawing Sheets

BELT DRIVE DEVICE AND IMAGE FORMING APPARATUS

CROSS-REFERENCE TO RELATED APPLICATION

This application claims priority under 35 USC 119 of prior Japanese Patent Application No. P 2009-211812 filed on Sep. 14, 2009, the entire contents of which are incorporated herein by reference.

BACKGROUND OF THE INVENTION

1. Field of the Invention

This application relates to a belt drive device and an image forming apparatus including the belt drive device.

2. Description of the Related Art

An image forming apparatus that incorporates a belt drive device, which drives a transfer belt that transports a sheet as a recording medium and transfers a toner image to the sheet, is well known. In the image forming apparatus, an image pattern used for correcting image density or a color shift is formed on the transfer belt and is detected by a detection sensor. Japanese Patent Laid-Open No. 2004-258281 discloses one such belt drive device.

In the aforementioned belt drive device, however, the distance between the detection sensor and the transfer belt is liable to vary due to plastic deformation of the transfer belt. When the plastic deformation is induced on the transfer belt, the detection sensor is unable to detect the image pattern properly, resulting in insufficient correction of the image density or the color shift. This will cause adverse effects on image quality.

SUMMARY OF THE INVENTION

An object of the application is to disclose a belt drive device and an image forming apparatus, capable of preventing loss of image quality caused by plastic deformation of a transfer belt.

In one aspect, a belt drive device for an image forming apparatus includes a belt, a roller, a roller drive member, a state detector and a controller. The roller drive member drives the roller that entrains the belt. The state detector detects a state of the belt. The controller identifies a specific portion of the belt based on the state detected by the state detector, and controls the roller drive member to stop the belt so that the specific portion lies at a predetermined position.

In another aspect, an image forming apparatus includes an image-forming unit, a belt, a roller, a roller drive member, a state detector and a controller. The image-forming unit forms an image on a recording medium transported by the belt. The roller drive member drives the roller that entrains the belt. The state detector detects a state of the belt. The controller identifies a specific portion of the belt based on the state detected by the state detector, and controls the roller drive member to stop the belt so that the specific portion lies at a predetermined position.

The full scope of applicability of the belt drive device and the image forming apparatus will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The belt drive device and the image forming apparatus will become more fully understood from the following detailed description with reference to the accompanying drawings, which are given by way of illustration only, and thus not to limit the invention, and wherein.

DETAILED DESCRIPTION OF THE INVENTION

Preferred embodiments of a belt drive device and an image forming apparatus according to the invention will be described in detail with reference to the accompanying drawings. In each embodiment, the description will be given with a tandem electrophotographic color printer as an image forming apparatus.

First Embodiment

Figure 1:
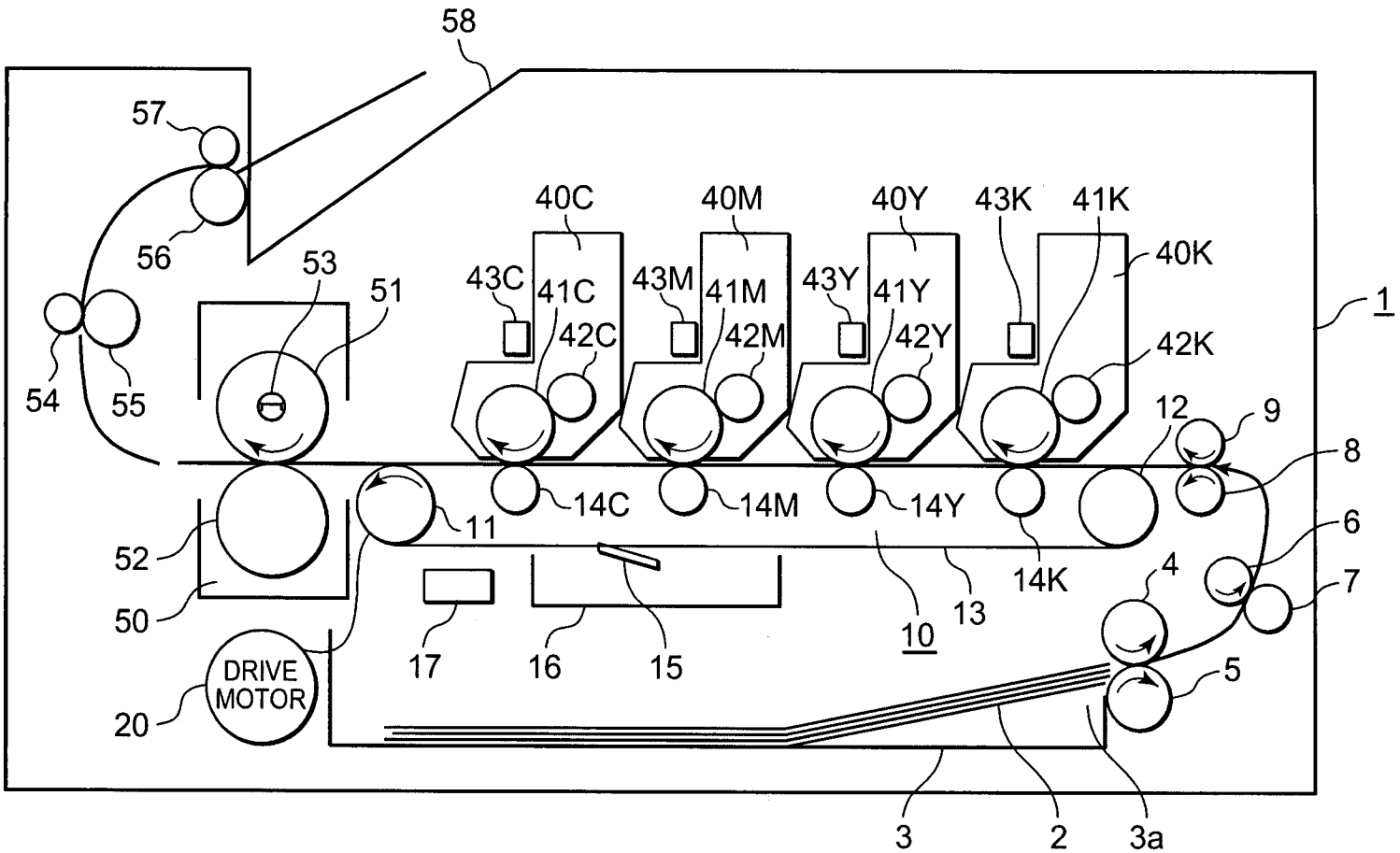
FIG. 1 is a schematic view of a printer of a first embodiment.

FIG. 1 is a schematic view of a printer 1 of a first embodiment, which may include a sheet cassette 3, a feed roller 4, a retard roller 5, a registration roller 6, a pressure roller 7, a registration roller 8, a pressure roller 9, a transfer belt unit 10, image-forming units 40K, 40Y, 40M and 40C, a fixing unit 50, a transport roller 54, a roller 55, a discharge roller 56, a roller 57 and a stacker 58.

The sheet cassette 3 is detachably mounted to the printer at the bottom thereof and accommodates a stack of sheets 2 as print media. The feed roller 4 is provided in the vicinity of a feed opening 3*a* of the sheet cassette and feeds the sheet in the sheet cassette. The retard roller 5 is in contact with the feed roller to separate each sheet. The registration roller 6 and the pressure roller 7, which are in contact with each other, are provided downstream of the feed roller and the retard roller in the sheet transport direction. The pressure roller 7 applies pressure to the registration roller 6 and is driven by the registration roller 6. The registration roller 8 and the pressure roller 9, which are in contact with each other, are provided downstream of the registration roller 6 and the pressure roller 7 in the sheet transport direction. The pressure roller 9 applies pressure to the registration roller 8 and is driven by the registration roller 8.

The transfer belt unit 10 as a belt drive device is provided downstream of the registration roller 8 and the pressure roller 9, and may include a drive roller 11, an idle roller 12, a transfer belt 13, transfer rollers 14K, 14Y, 14M and 14C, a cleaning blade 15, a waste toner box 16 and an optical sensor unit 17.

The drive roller 11 is driven by a drive motor 20 as a roller drive member. The idle roller 12 is provided at a predetermined distance from the drive roller, and is driven by the drive roller through the transfer belt 13. The idle roller also provides tension to the transfer belt. The transfer belt, which is endless, is entrained about the drive roller and the idle roller, and is rotated by the friction between the drive roller and the transfer belt, thereby transporting the sheet in the sheet transport direction.

Each of the transfer rollers 14K, 14Y, 14M and 14C is in contact with an inner surface of the transfer belt 13. The transfer roller 14K is pressed toward the image-forming unit 40K, which forms a black toner image. The transfer roller 14K receives a transfer voltage from a power supply, not shown, and transfers the black toner image formed by the image-forming unit 40K to the sheet or the transfer belt. Similarly to the transfer roller 14K, the transfer rollers 14Y, 14M and 14C respectively transfer a yellow toner image formed by the image-forming unit 40Y, a magenta toner image formed by the image-forming unit 40M and a cyan toner image formed by the image-forming unit 40C to the sheet or the transfer belt.

The cleaning blade 15 is in contact with the transfer belt 13, and scrapes toner off the transfer belt. The waste toner box 16 collects the scraped off toner. The optical sensor unit 17 as a state detector opposes to the transfer belt, and detects an image pattern, which is formed on the transfer belt and is used for correcting image density or a color shift.

As described above, the transfer belt unit 10 transfers the toner images to the sheet, and transports the sheet. In addition to that, the transfer belt unit forms the image pattern for correcting the image density or the color shift on the transfer belt 13, and detects the image pattern with the optical sensor unit 17.

The image-forming units 40K, 40Y, 40M and 40C respectively form the black toner image, the yellow toner image, the magenta toner image and the cyan toner image. The image-forming unit 40K may include a photosensitive drum 41K, a developing roller 42K and an exposure head 43K. The photosensitive drum 41K as an image-bearing body bears an electrostatic latent image. The developing roller 42K develops the electrostatic latent image with black toner supplied from a supply roller, not shown, thereby forming the black toner image on the photosensitive drum 41K. The exposure head 43K exposes a surface of the photosensitive drum 41K to form the electrostatic latent image. Similarly to the image-forming unit 40K, the image-forming unit 40Y may include a photosensitive drum 41Y, a developing roller 42Y and an exposure head 43Y, and forms the yellow toner image on the photosensitive drum 41Y. The image-forming unit 40M may include a photosensitive drum 41M, a developing roller 42M and an exposure head 43M, and forms the magenta toner image on the photosensitive drum 41M. The image-forming unit 40C may include a photosensitive drum 41C, a developing roller 42C and an exposure head 43C, and forms the cyan toner image on the photosensitive drum 41C.

The fixing unit 50 is provided downstream of the transfer belt unit 10 in the sheet transport direction, and may include a fixing roller 51, a pressure roller 52 and a heater 53. The fixing roller 51 rotates in the direction of an arrow in FIG. 1. The pressure roller 52 is pressed toward the fixing roller, and is driven by the fixing roller. The heater 53 such as a halogen lamp heats the fixing roller. The fixing unit fixes the toner images transferred to the sheet by the transfer belt unit, onto the sheet with heat and pressure.

The transport roller 54, the roller 55, the discharge roller 56 and the roller 57 are provided downstream of the fixing unit 50 in the sheet transport direction. The transport roller and the roller 55 are in contact with each other, and the transport roller drives the roller 55. The discharge roller and the roller 57 are in contact with each other, and the discharge roller drives the roller 57. The transport roller, the roller 55, the discharge roller and the roller 57 transport the sheet with the toner images thereon to the stacker 58 where the sheet is held face down.

Next, a printing operation of the printer will be described with reference to FIG. 1. When the printing operation is initiated, the feed roller 4 and the retard roller 5 separate each sheet accommodated in the sheet cassette 3, and feed it one by one. The registration roller 6, the pressure roller 7, the registration roller 8 and the pressure roller 9 transport the sheet fed from the sheet cassette to the transfer belt 13. The transfer belt transports the sheet between the photosensitive drum 41K and the transfer roller 14K.

The transfer roller 14K transfers the black toner image on the photosensitive drum 41K to the sheet. The photosensitive drum 41K and the transfer belt 13 transport the sheet with the black toner image thereon to the image-forming unit 40Y. The transfer roller 14Y transfers the yellow toner image on the photosensitive drum 41Y to the sheet. The photosensitive drum 41Y and the transfer belt transport the sheet with the black toner image and the yellow toner image thereon to the image-forming unit 40M. The transfer roller 14M transfers the magenta toner image on the photosensitive drum 41M to the sheet. The photosensitive drum 41M and the transfer belt transport the sheet with the black toner image, the yellow toner image and the magenta toner image thereon to the image-forming unit 40C. The transfer roller 14C transfers the cyan toner image on the photosensitive drum 41C to the sheet. In this manner, the black toner image, the yellow toner image, the magenta toner image and the cyan toner image are sequentially superimposed on and transferred to the sheet.

The fixing unit 50 fixes the toner images transferred to the sheet onto the sheet. The transport roller 54, the roller 55, the discharge roller 56 and the roller 57 transport the sheet with the fixed toner images thereon to the stacker 58 where the sheet is held face down.

Figure 2:
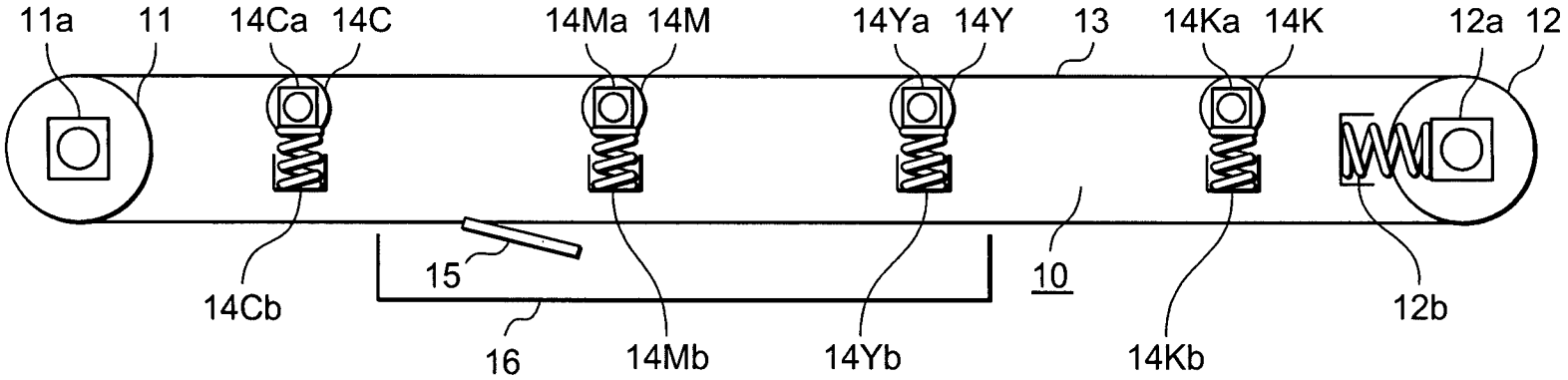
FIG. 2 is a side view of a transfer belt unit of the first embodiment.
Figure 3:
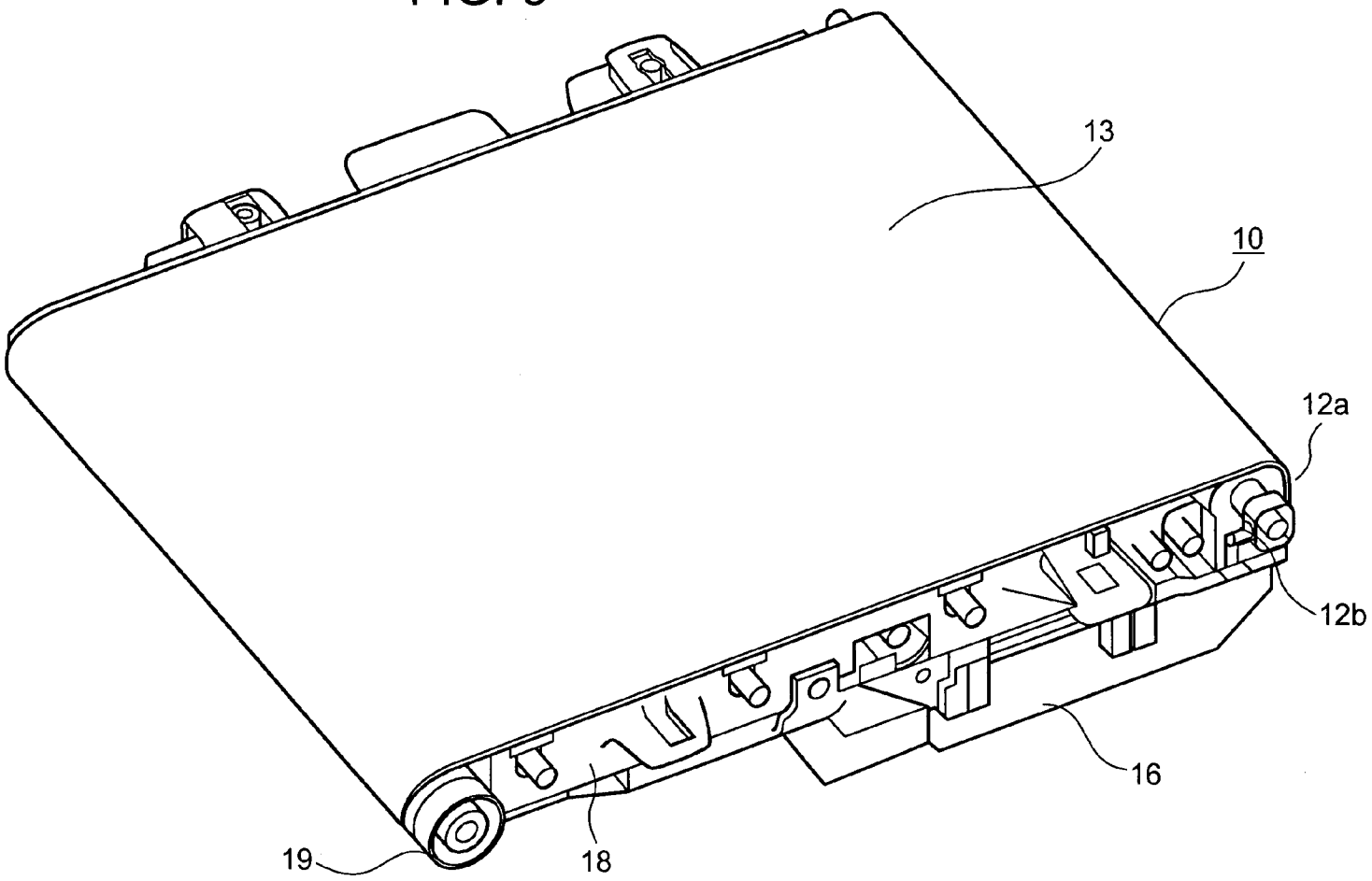
FIG. 3 is a perspective view of the transfer belt unit of the first embodiment.

Next, the transfer belt unit 10 will be described in detail. FIGS. 2 and 3 are respectively a side view and a perspective view of the transfer belt unit.

The transfer belt unit 10 is mounted to a belt frame 18 of the printer. The belt frame incorporates a first bearing 11*a*, a second bearing 12*a*, a third bearing 14Ka, a fourth bearing 14Ya, a fifth bearing 14Ma and a sixth bearing 14Ca. The bearings 11*a* and 12*a* respectively support axes of the drive roller 11 and the idle roller 12. The bearings 14Ka, 14Ya, 14Ma and 14Ca respectively support axes of the transfer rollers 14K, 14Y, 14M and 14C. In addition, the belt frame incorporates a first spring 12*b* that provides the tension to the transfer belt 13 through the bearing 12*a* and the idle roller.

The belt frame also includes a second spring 14Kb, a third spring 14Yb, a fourth spring 14Mb and a fifth spring 14Cb that respectively press the transfer rollers 14K, 14Y, 14M and 14C toward the transfer belt. As shown in FIG. 3, a drive gear 19 is firmly fixed on the axis of the drive roller, and rotates the drive roller with a driving force from the drive motor 20 in FIG. 1.

The cleaning blade 15, which scrapes toner off the transfer belt 13, is fixed on the belt flame 18 through a holder, not shown. The waste toner box 16 collects the scraped off toner.

Figure 4:
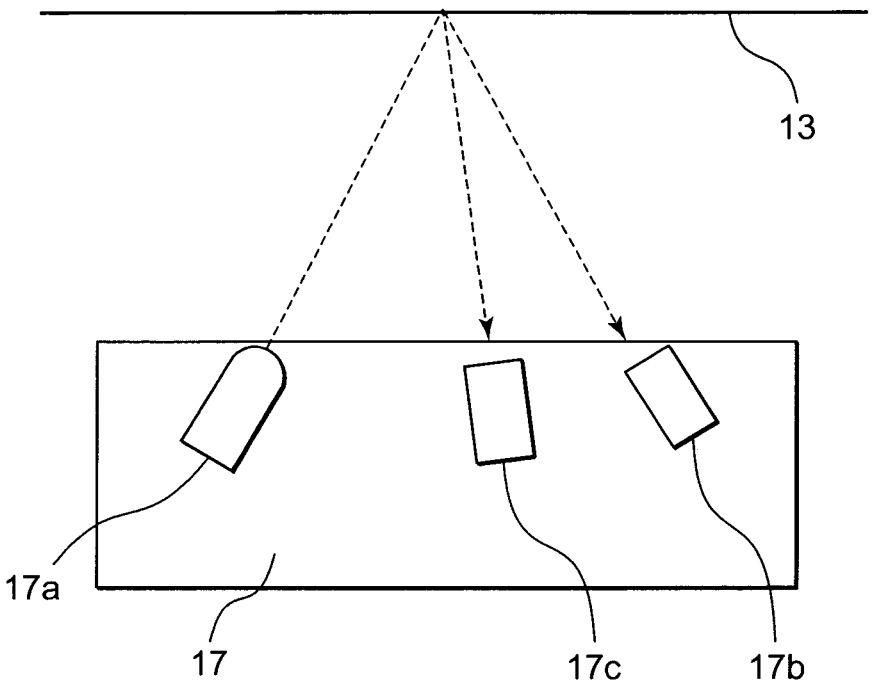
FIG. 4 is a schematic view of an optical sensor unit of the first embodiment.

Next, the optical sensor unit 17 will be described in detail. FIG. 4 is a schematic view of the optical sensor unit, which detects optical characteristics of the transfer belt 13 and of the toner image formed on the transfer belt.

Referring to FIG. 4, the optical sensor unit 17 may include a light-emitting element 17*a*, a first light-receiving element 17*b* and a second light-receiving element 17*c*. The light-emitting element 17*a* directs light toward the transfer belt 13. The first light-receiving element 17*b* receives light specularly reflected from the transfer belt, and outputs an electrical signal corresponding to the intensity of the specularly-reflected light. The second light-receiving element 17*c* receives light diffusely reflected from the transfer belt, and outputs an electrical signal corresponding to the intensity of the diffusely-reflected light. In addition, the optical sensor unit may include an amplifier circuit, not shown, to amplify these electrical signals. The amplifier circuit transmits the amplified electrical signals, i.e., output voltage signals, to a controller 60 described later.

The printer corrects the density of the respective toner images to be formed by the image-forming units 40K, 40Y, 40M and 40C based on the electrical signals from the optical sensor unit 17. In addition, the printer corrects a color shift by adjusting emission timing of each of the exposure heads 43K, 43Y, 43M and 43C based on the electrical signals so that the respective toner images are properly superimposed.

Figure 5:
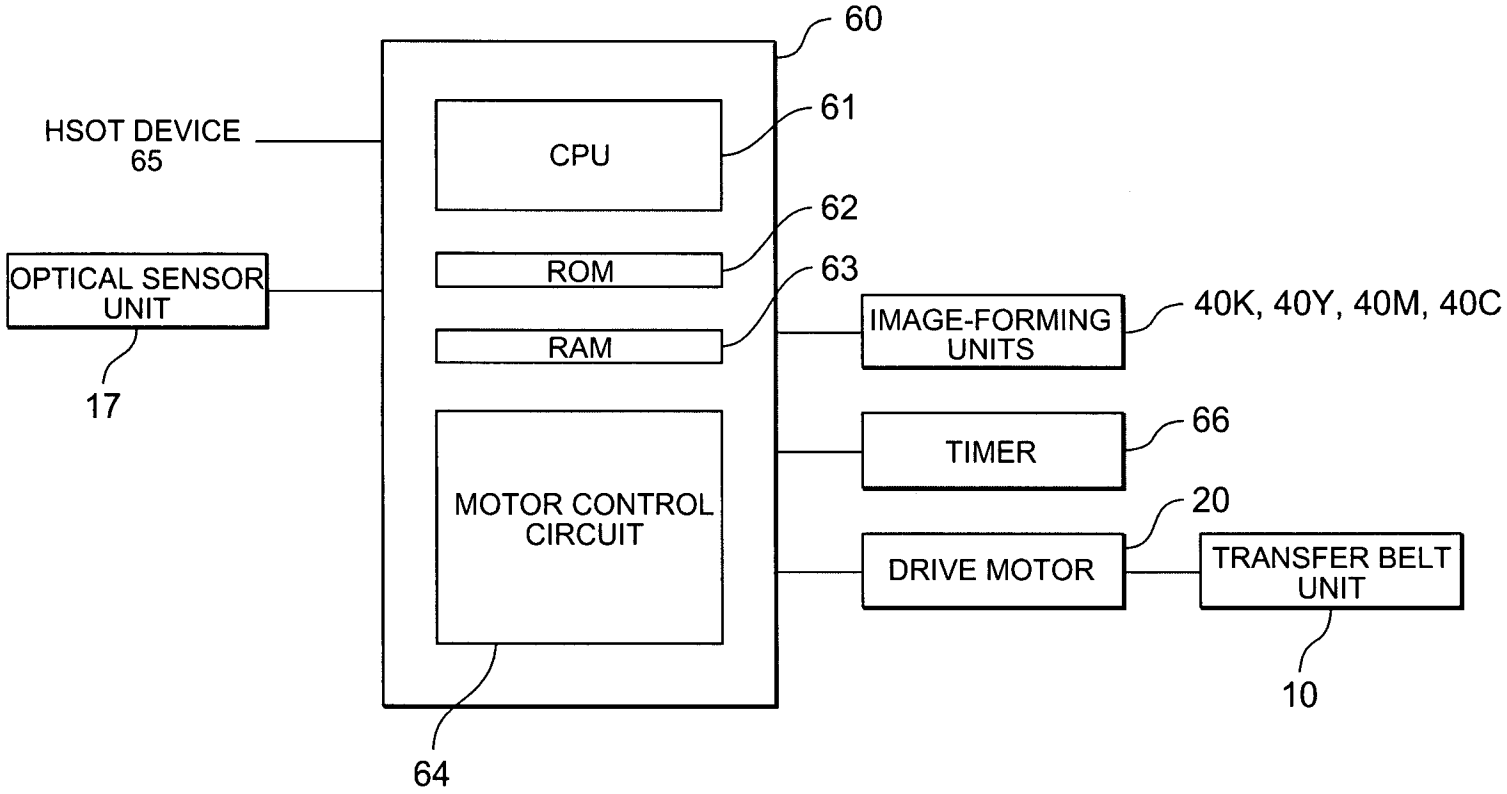
FIG. 5 is a block diagram of a control system of the printer of the first embodiment.

Next, a control system of the printer will be described. FIG. 5 is a block diagram of the control system, which centers on the controller 60.

Referring to FIG. 5, the controller 60, which controls the entire printer according to control programs, may include a CPU (Central Processing Unit) 61, a ROM (Read Only Memory) 62, a RAM (Random Access Memory) 63 and a motor control circuit 64. The CPU 61 performs a computing process including a calculation of an average value of the output voltage from the second light-receiving element 17*c* of the optical sensor unit 17, described later. The ROM 62 stores a wide variety of the control programs and the RAM 63 stores a wide variety of data. The motor control circuit 64 as a roller drive controller controls the drive motor 20 that drives the drive roller 11 of the transfer belt unit 10, according to a command from the CPU.

The controller 60 is connected with a host device 65, the optical sensor unit 17, the image-forming units 40K, 40Y, 40M and 40C, the drive motor 20 and a timer 66. The controller receives a command from the host device, which may be provided outside or inside of the printer, and also receives the electrical signals from the optical sensor unit. In addition, the controller transmits a control signal to each of the image-forming units, and also transmits a control signal to the drive motor through the motor control circuit.

As described above, the CPU 61 calculates the average value of the output voltage from the second light-receiving element 17*c* according to the control programs stored in the ROM 62, and stores the average value and information on a proper stop position of a specific portion of the transfer belt 13 available from the average value, to the RAM 63. In addition, the CPU transmits a command to the drive motor 20 based on a count value of the timer 66, so as to stop the transfer belt with its specific portion at the proper stop position.

Figure 6:
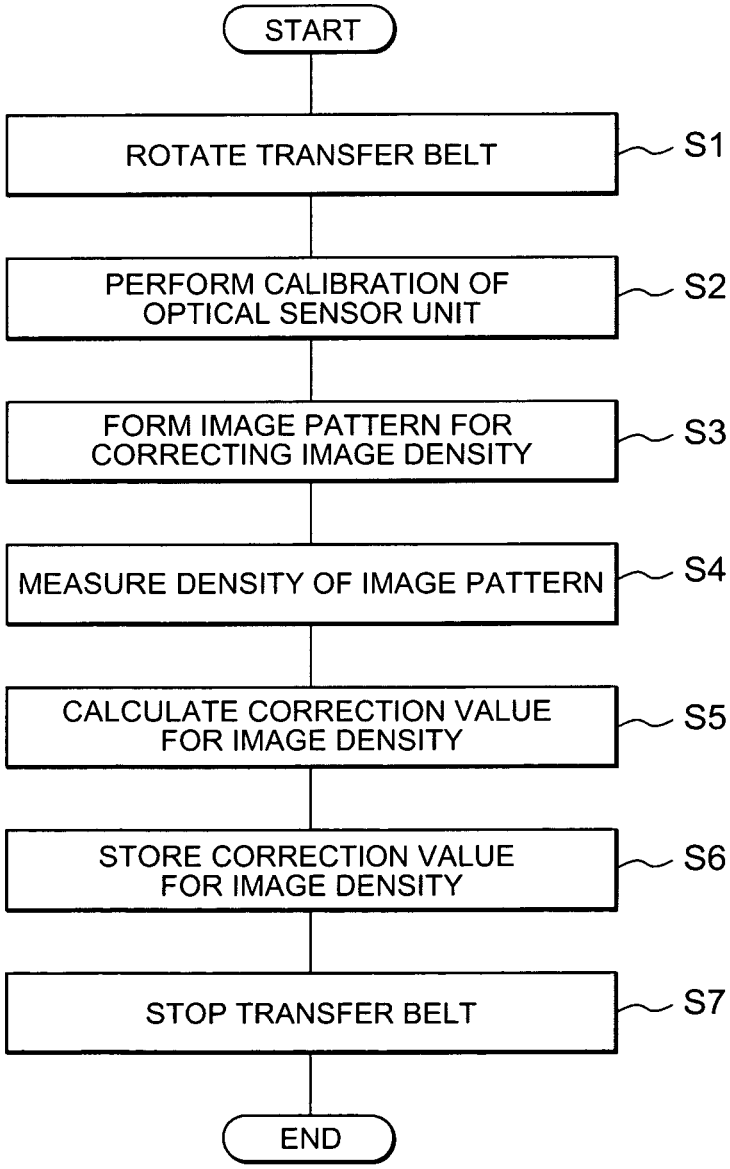
FIG. 6 is a flow chart of a corrective operation for image density in the printer of the first embodiment.

Next, an operation for correcting image density of the printer will be described. FIG. 6 is a flow chart of the corrective operation for the image density in the printer.

Referring to FIG. 6, in the printer, the CPU 61 performs this corrective operation according to the control programs stored in the ROM 62 so that the image is maintained at a predetermined density, as follows:

At S1, the motor control circuit 64 drives the drive motor 20 to rotate the drive roller 11 of the transfer belt unit 10, thereby rotating the transfer belt 13.

At S2, the light-emitting element 17*a* of the optical sensor unit 17 directs light toward the transfer belt 13. The first light-receiving element 17*b* receives light specularly reflected from the transfer belt, and outputs an output voltage signal corresponding to the intensity of the specularly-reflected light. The optical sensor unit adjusts a current supplied to the light-emitting element so that the output voltage signal is to be at a predetermined level, i.e., the optical sensor unit performs self-calibration.

At S3, the image-forming units 40K, 40Y, 40M and 40C, and the transfer rollers 14K, 14Y, 14M and 14C form an image pattern for correcting the image density on the transfer belt 13.

At S4, when the image pattern reaches a position where the image pattern faces the optical sensor unit 17, the optical sensor unit initiates a measurement of the density of the image pattern.

At S5, the CPU 61 calculates a correction value for the image density based on the density of the image pattern measured by the optical sensor unit 17.

At S6, the CPU 61 stores the correction value for the image density to the RAM 63.

At S7, the motor control circuit 64 stops the drive of the drive motor 20, thereby stopping the rotation of the transfer belt 13.

In this manner, the printer performs the corrective operation for the image density. In a printing operation performed after the corrective operation, the image-forming units 40K, 40Y, 40M and 40C are controlled based on the correction value stored in the RAM 63 so as to print toner images on the sheet at the predetermined density.

Next, an operation for correcting a color shift of the printer will be described. In this corrective operation, an image pattern for correcting the color shift is formed on the transfer belt 13 in place of the image pattern for correcting the image density. The optical sensor unit 17 measures the amount of the color shift of the image pattern. The CPU 61 calculates a correction value for the color shift based on the amount of the color shift of the image pattern measured by the optical sensor unit, and stores the correction value to the RAM 63.

In this manner, the printer performs the corrective operation for the color shift. In a printing operation performed after the corrective operation, emission timing of each of the exposure heads 43K, 43Y, 43M and 43C is adjusted based on the correction value stored in the RAM 63 so that respective toner images are properly superimposed.

Figure 7:
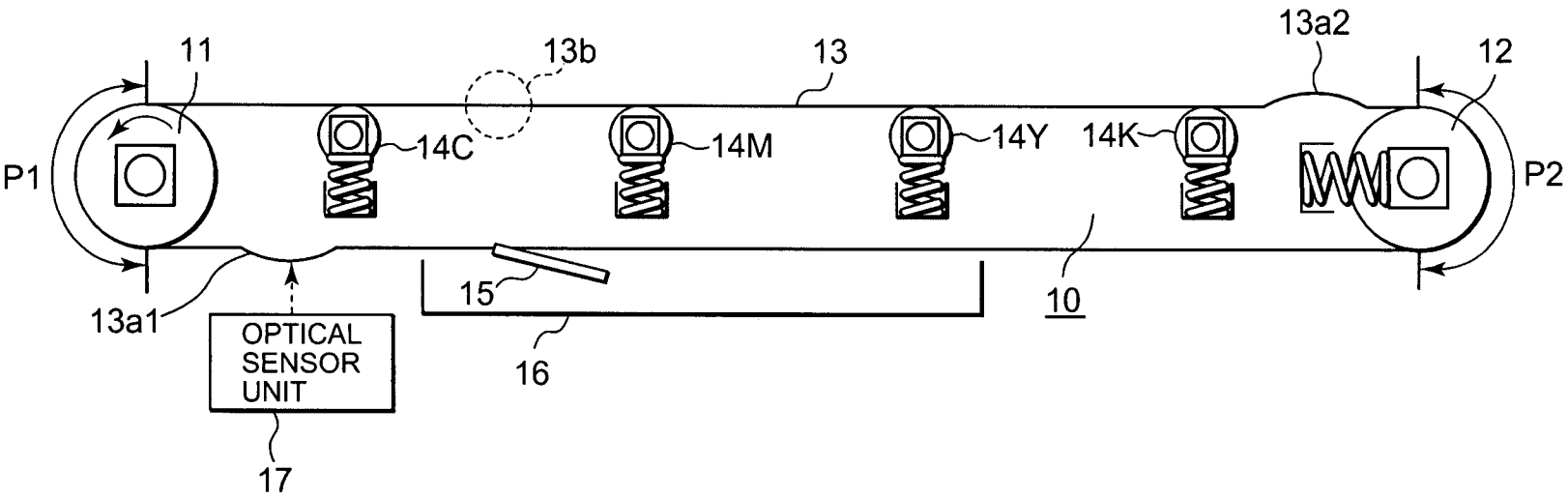
FIG. 7 is a side view of the transfer belt unit in which a transfer belt has been plastically deformed.

Next, a stop control of the transfer belt 13 will be described. FIG. 7 is a side view of the transfer belt unit 10 in which the transfer belt has been plastically deformed.

Referring to FIG. 7, if the transfer belt 13 is left under tension over long periods, the tension will directly subject the transfer belt to stresses. Especially, the transfer belt is subjected to bending stresses in addition to the stresses directly caused by the tension, at both of a first curved portion P1 where the transfer belt is in contact with the drive roller 11 and at a second curved portion P2 where the transfer belt is in contact with the idle roller 12. Therefore, the transfer belt is liable to deform at both of the curved portions P1 and P2. In this case, a first deformity 13*a*1 and a second deformity 13*a*2, which are respectively formed at the curved portions P1 and P2, appear on the transfer belt. The amount of deformation depends on the thickness and Young's modulus of the transfer belt, diameters of the drive roller and the idle roller, the tension in the transfer belt, the period and environment in which the transfer belt is under tension, and the like. Each of the deformities 13*a*1 and 13*a*2 on transfer belt is typically called a curl.

In FIG. 7, the deformity 13*a*1 corresponds to a curl that occurs at the curved portion P1, and the deformity 13*a*2 corresponds to a curl that occurs at the curved portion P2. In addition, a smooth portion 13*b* of the transfer belt 13 corresponds to a portion where the amount of deformation is at a minimum.

Figure 8:
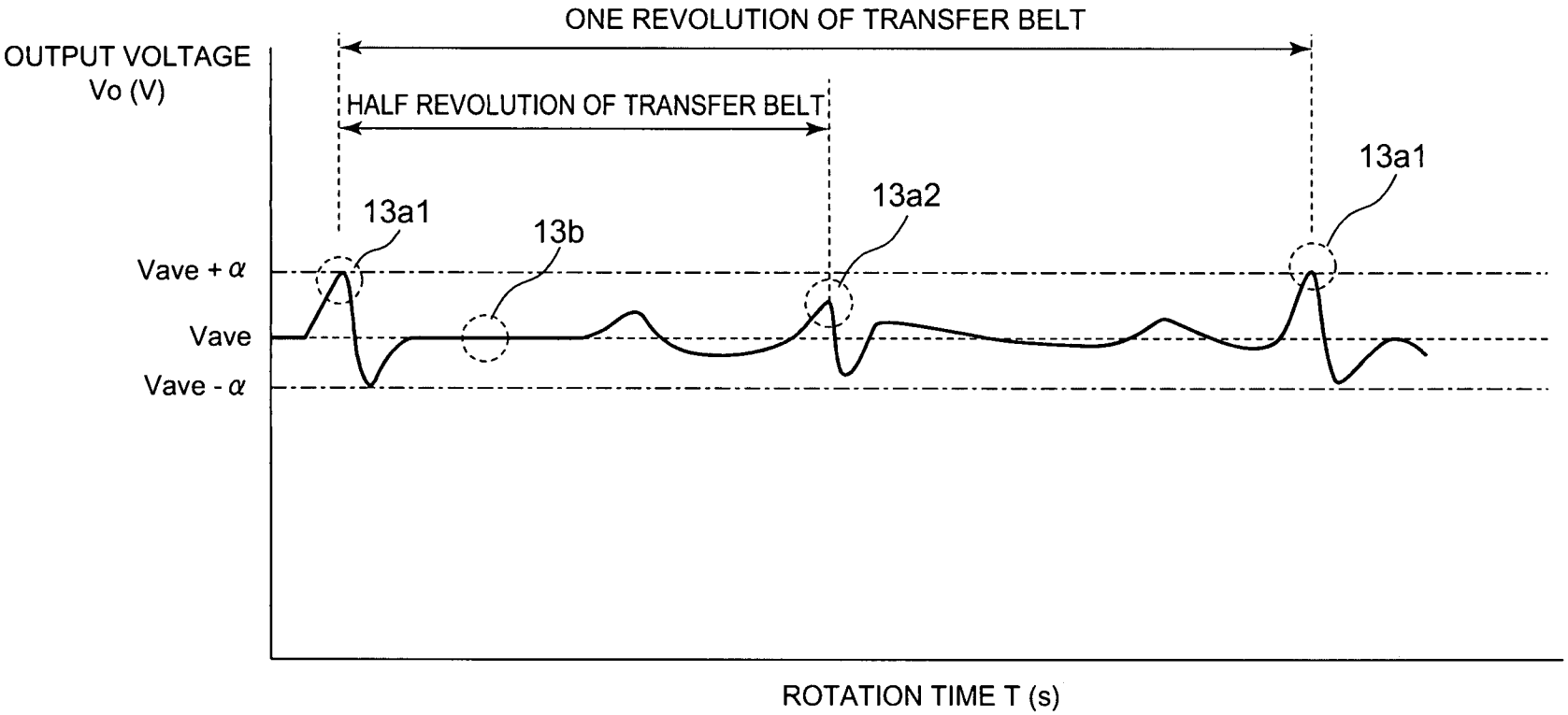
FIG. 8 is a first waveform diagram of an output voltage signal from a second light-receiving element of the optical sensor unit of the first embodiment.

FIG. 8 is a first waveform diagram of an output voltage signal from the second light-receiving element 17*c* of the optical sensor unit 17, in which abscissa and ordinate axes respectively denote a rotation time T (s) of the transfer belt 13, and an output voltage Vo (V) from the optical sensor unit. Symbols Vave, Vave+α and Vave−α respectively denote an average value, a maximum value and a minimum value of the output voltage Vo in one revolution of the transfer belt.

The amount of deformation of the transfer belt 13 corresponds to a voltage difference ΔV between the output voltage Vo and the average value Vave. The larger the voltage difference ΔV, the larger the amount of deformation. It should be noted that an output voltage Vo corresponding to the smooth portion 13*b* of the transfer belt is close to the average value Vave.

As shown in FIG. 7, if the deformities 13*a*1 and 13*a*2 occur on the transfer belt 13, the distance between the transfer belt and the optical sensor unit 17 varies at the deformities. Consequently, the output voltage Vo from the optical sensor unit sharply changes at positions corresponding to these deformities, as shown in FIG. 8. The amplitude of the output voltage signal from the optical sensor unit changes depending on the distance and angle between the transfer belt and the optical sensor unit. That is to say, the larger the amount of deformation of the transfer belt becomes, the larger the amplitude of the output voltage signal from the optical sensor unit becomes.

In the first embodiment, the controller 60 detects the smooth portion 13*b* on the transfer belt 13 with the optical sensor unit 17, and stops the transfer belt so that the smooth portion lies at the curved portion P1 or P2. In other words, the controller stops the transfer belt so that the deformities 13*a*1 and 13*a*2 do not lie at the curved portions. This prevents the amount of deformation of the transfer belt at the deformities from increasing.

Figure 9:
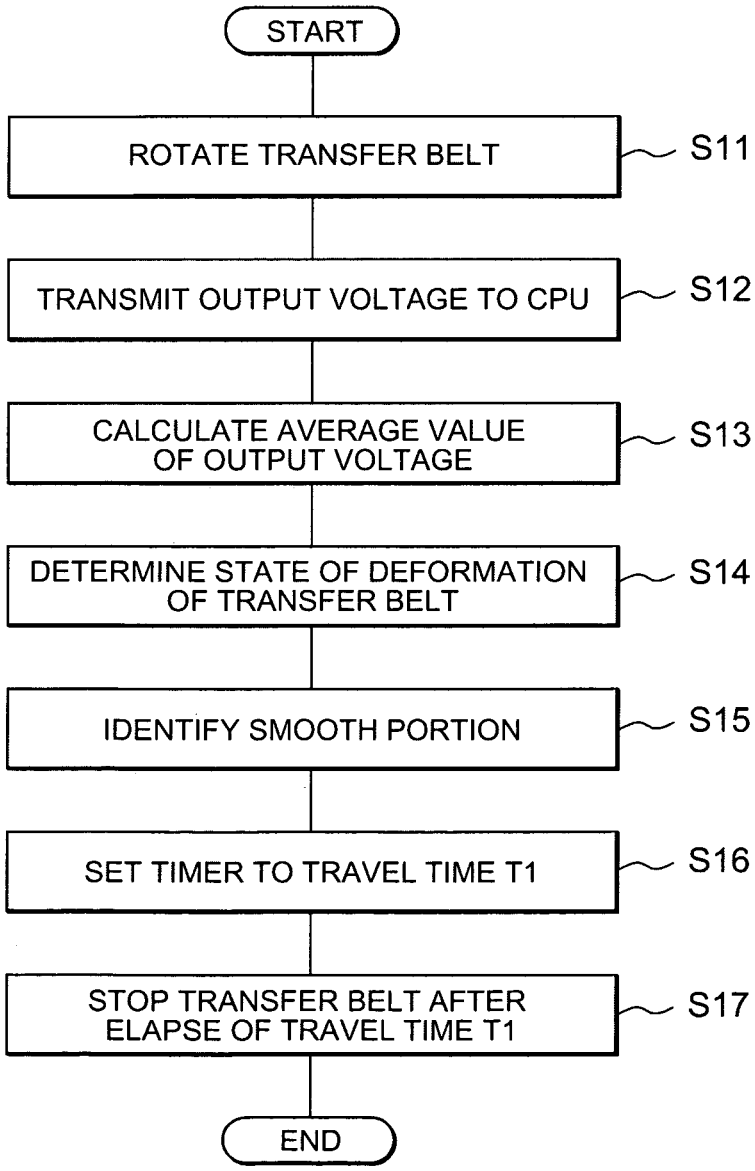
FIG. 9 is a flow chart of a stop control of the transfer belt in the printer of the first embodiment.

FIG. 9 is a flow chart of the stop control of the transfer belt 13 in the printer, which is performed by the CPU 61 according to the control programs stored in the ROM 62, as follows:

At S11, the motor control circuit 64 drives the drive motor 20 to rotate the drive roller 11 of the transfer belt unit 10, thereby rotating the transfer belt 13.

At S12, the light-emitting element 17*a* of the optical sensor unit 17 directs light toward the transfer belt 13. The second light-receiving element 17*c* receives light reflected from the transfer belt. The optical sensor unit transmits an output voltage signal corresponding to the intensity of the reflected light to the CPU 61.

At S13, the CPU 61 calculates the average value Vave of the output voltage Vo in one revolution of the transfer belt 13.

At S14, the CPU 61 determines the state of deformation of the transfer belt 13. Specifically, first, the CPU calculates the voltage difference ΔV between the output voltage Vo and the average value Vave as follows:

$$|Vave-Vo|=\Delta V.$$

Then, the CPU determines the state of deformation, i.e., the amount of deformation of the transfer belt, based on the voltage difference ΔV.

At S15, the CPU 61 identifies the smooth portion 13*b* where the amount of deformation of the transfer belt 13 is at a minimum.

At S16, the CPU 61 sets the timer 66 to a travel time T1 in which the smooth portion 13*b* travels from a position opposed to the optical sensor unit 17 to the curved portion P2. The travel time T1 has been calculated in advance based on the distance between the position opposed to the optical sensor unit and the curved portion P2, and the speed of rotation of the transfer belt 13.

At S17, when the optical sensor unit 17 detects the smooth portion 13*b*, the CPU 61 commands the timer 66 to initiate counting. After the travel time T1 has elapsed, the CPU commands the motor control circuit 64 to stop the rotation of the transfer belt 13. As a result, the transfer belt stops in a condition in which the smooth portion lies at the curved portion P2.

Alternatively, at S16 and S17, the transfer belt 13 may be stopped in a condition in which the smooth portion 13*b* lies at the curved portion P1. In this case, the CPU 61 sets the timer 66 to a travel time T2 in which the smooth portion travels from the position opposed to the optical sensor unit 17 to the curved portion P1. When the optical sensor unit detects the smooth portion, the CPU commands the timer to initiate counting. After the travel time T2 has elapsed, the CPU commands the motor control circuit 64 to stop the rotation of the transfer belt.

Figure 10:
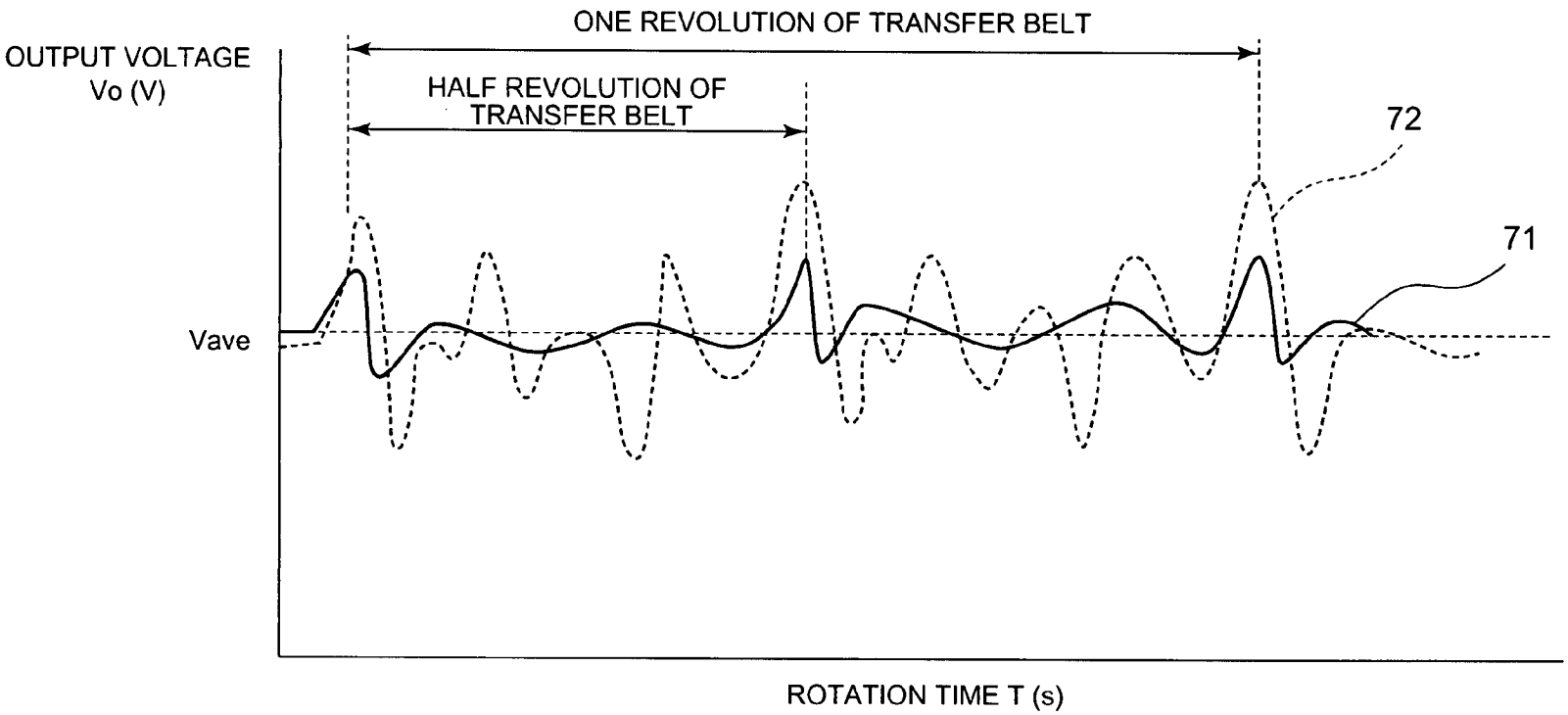
FIG. 10 is a second waveform diagram of output voltage signals from the second light-receiving element of the optical sensor unit of the first embodiment.

Next, advantages of the stop control of the transfer belt 13 will be described. FIG. 10 is a second waveform diagram of output voltage signals from the second light-receiving element 17*c* of the optical sensor unit 17, in which abscissa and ordinate axes respectively denote a rotation time T (s) of the transfer belt, and an output voltage Vo (V) from the optical sensor unit. The symbol Vave denotes the average value of the output voltage Vo in one revolution of the transfer belt. A voltage waveform 71, shown in a solid line, is a waveform of an output voltage signal from the optical sensor unit in the case where the stop control of the transfer belt of the first embodiment has been performed. Meanwhile, a voltage waveform 72, shown in a broken line, is that of an output voltage signal from the optical sensor unit in the case where the stop control of the transfer belt of the first embodiment has not been performed.

As shown by the voltage waveform 72, when the stop control of the transfer belt 13 has not been performed, there is a possibility that multiple deformities will occur on the transfer belt and that each of the deformities will increase.

On the other hand, as shown by the voltage waveform 71, when the stop control of the transfer belt 13 of the first embodiment has been performed, the amplitude of the voltage waveform 71 becomes smaller than that of the voltage waveform 72. This indicates that each of the deformities becomes smaller.

As described above, in the first embodiment, the controller 60 detects the smooth portion 13*b* on the transfer belt 13 with the optical sensor unit 17, and stops the transfer belt so that the detected smooth portion lies at the curved portion P1 or P2. In other words, the controller stops the transfer belt so that the deformities 13*a*1 and 13*a*2 do not lie at the curved portions. Therefore, the printer is capable of preventing these deformities from increasing, thereby reducing a variation of the distance between the optical sensor unit and the transfer belt caused by the plastic deformation of the transfer belt. Thus, the printer is capable of correcting the image density or the color shift properly. Moreover, the printer is also capable of preventing other problems associated with the plastic deformation of the transfer belt, such as a stain on a back side of the sheet caused by insufficiency of cleaning of the transfer belt by the cleaning blade 15.

First Modification

Figure 11:
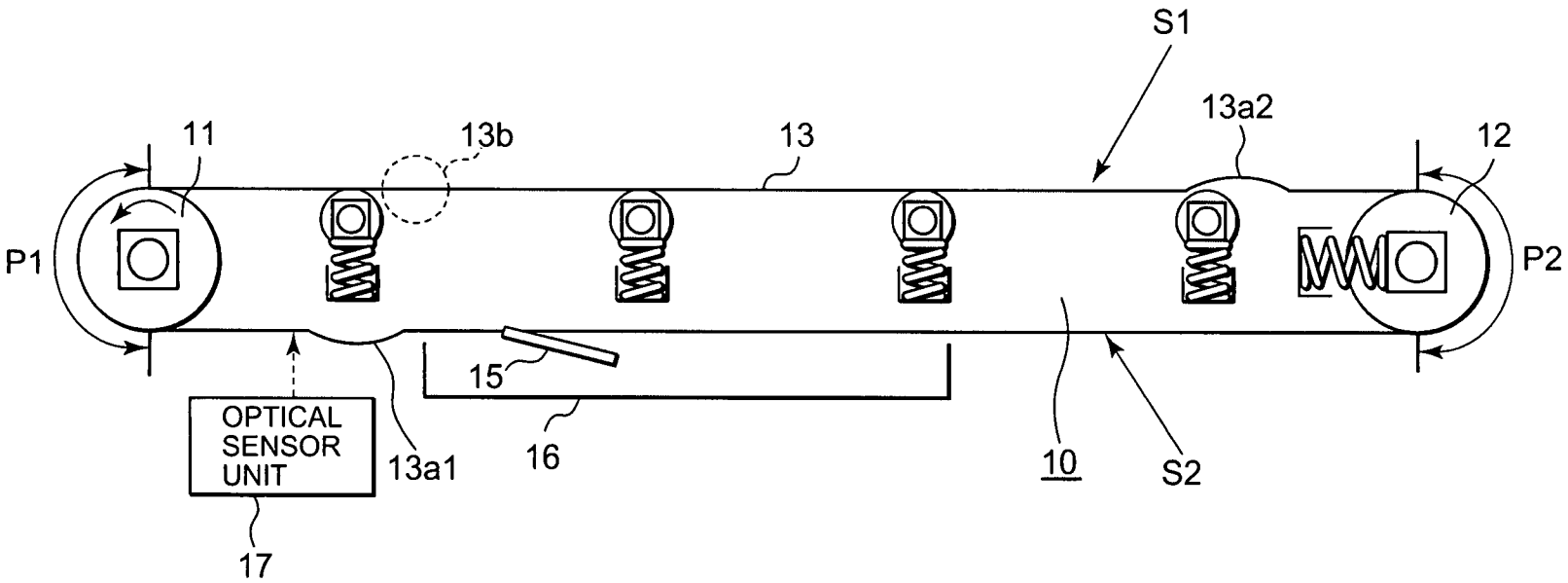
FIG. 11 is a side view of the transfer belt unit of a first modification.

FIG. 11 is a side view of the transfer belt unit 10 of a first modification, which has the same elements as those in FIG. 7.

As described above, in the first embodiment, the controller 60 detects the smooth portion 13*b* where the output voltage Vo is closest to the average value Vave, with the optical sensor unit 17, and stops the transfer belt 13 so that the smooth portion lies at the curved portion P1 or P2.

On the other hand, in the first modification, the controller 60 detects the deformity 13*a*1 or 13*a*2 where the output voltage Vo is at a maximum, with the optical sensor unit 17, and stops the transfer belt 13 so that the deformity 13*a*1 or 13*a*2 lies downstream and in the vicinity of the optical sensor unit in the rotational direction of the transfer belt, as shown in FIG. 11. For instance, the controller stops the transfer belt so that the deformity 13*a*1 lies 20 mm downstream of the optical sensor unit in the rotational direction of the transfer belt. However, it should be noted that the controller may stop the transfer belt so that the deformity 13*a*1 lies within the range of 20 mm downstream of the optical sensor unit.

Figure 12:
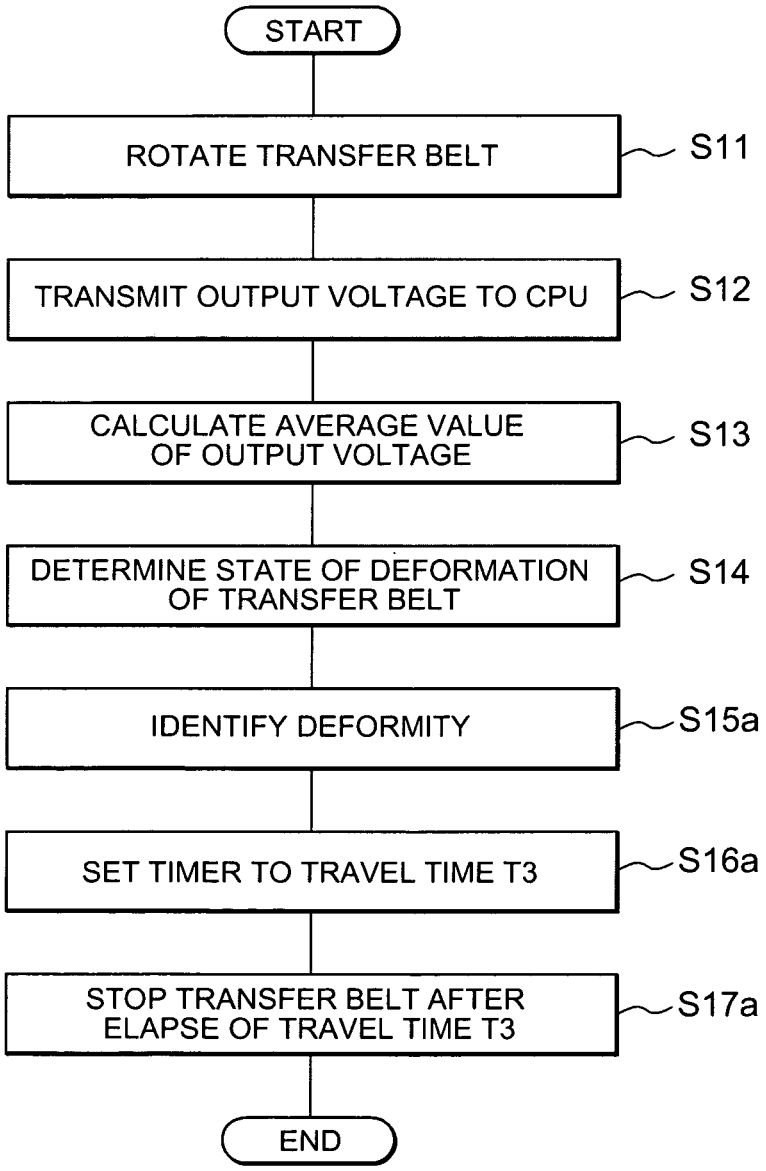
FIG. 12 is a flow chart of a stop control of the transfer belt in the printer of the first modification.

FIG. 12 is a flow chart of a stop control of the transfer belt 13 in the printer of the first modification. In FIG. 12, the same processes as those shown in FIG. 9 are designated by the same numerals. This stop control is performed by the CPU 61 according to the control programs stored in the ROM 62, as follows:

At S11 to S14, the same processes as those shown in FIG. 9 are performed.

At S15*a*, the CPU 61 identifies the deformity 13*a*1 where the amount of deformation of the transfer belt 13 is at a maximum.

At S16*a*, the CPU 61 sets the timer 66 to a travel time T3 in which the deformity 13*a*1 travels from a first position opposed to the optical sensor unit 17 to a second position that is 20 mm downstream of the optical sensor unit in the rotational direction of the transfer belt 13. The travel time T3 has been calculated in advance based on the distance between the first and second positions, and the speed of rotation of the transfer belt.

At S17*a*, when the optical sensor unit 17 detects the deformity 13*a*1, the CPU 61 commands the timer 66 to initiate counting. After the travel time T3 has elapsed, the CPU commands the motor control circuit 64 to stop the rotation of the transfer belt 13. As a result, the transfer belt stops in a condition in which the deformity 13*a*1 lies 20 mm downstream of the optical sensor unit.

As described above, in the first modification, the controller 60 detects the deformity 13*a*1 or 13*a*2 with the optical sensor unit 17, and stops the transfer belt 13 so that the detected deformity lies downstream and in the vicinity of the optical sensor unit. Therefore, the printer is capable of stopping the transfer belt quickly.

Second Modification

In a second modification, the controller 60 detects the deformity 13*a*1 or 13*a*2 where the output voltage Vo is at a maximum, with the optical sensor unit 17, and stops the transfer belt 13 so that the deformity 13*a*1 or 13*a*2 does not face the image-forming units 40K, 40Y, 40M and 40C. For instance, as shown in FIG. 11, the controller stops the transfer belt so that the deformity 13*a*1 lies on a second side S2, which is opposite to a first side S1 where the transfer belt faces the image-forming units.

Figure 13:
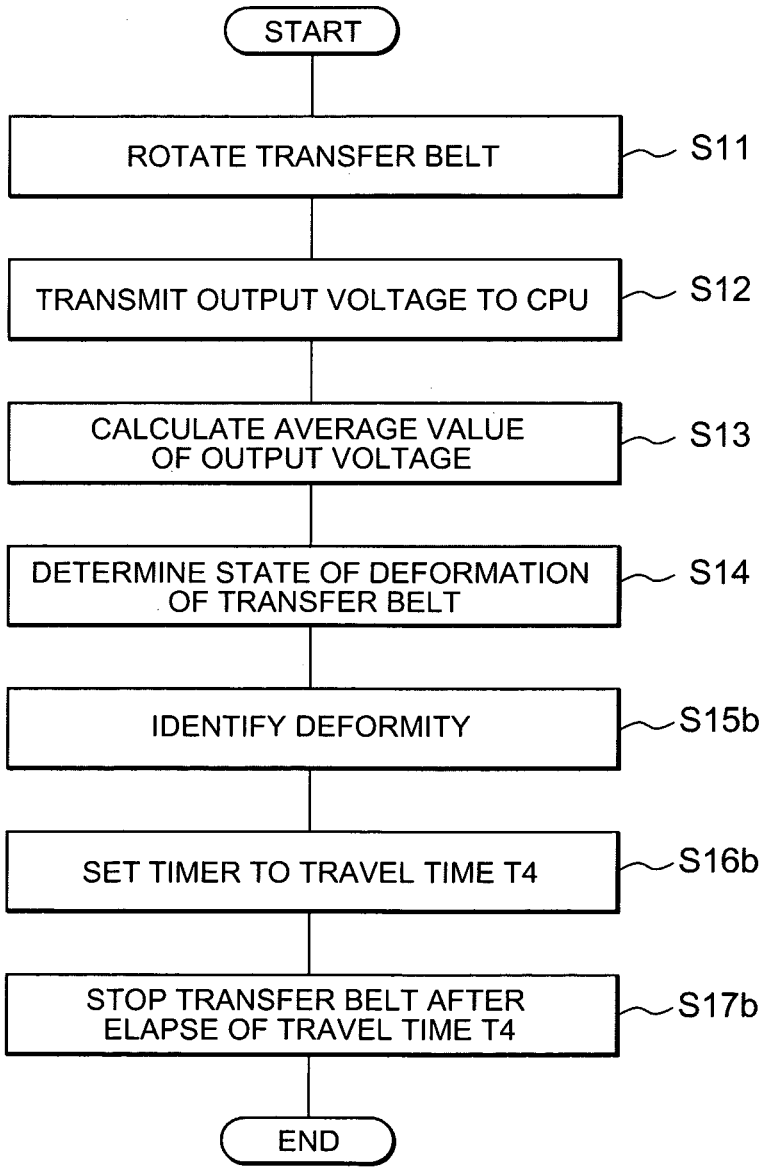
FIG. 13 is a flow chart of a stop control of the transfer belt in the printer of a second modification.

FIG. 13 is a flow chart of a stop control of the transfer belt 13 in the printer of the second modification. In FIG. 13, the same processes as those shown in FIG. 9 are designated by the same numerals. This stop control is performed by the CPU 61 according to the control programs stored in the ROM 62, as follows:

At S11 to S14, the same processes as those shown in FIG. 9 are performed.

At S15*b*, the CPU 61 identifies the deformity 13*a*1 where the amount of deformation of the transfer belt 13 is at a maximum.

At S16*b*, the CPU 61 sets the timer 66 to a travel time T4 in which the deformity 13*a*1 travels from a first position opposed to the optical sensor unit 17 to a second position that is between the first position and the curved portion P2. The second position may be an intermediate position between the first position and the curved portion P2. The travel time T4 has been calculated in advance based on the distance between the first and second positions, and the speed of rotation of the transfer belt 13.

At S17*b*, when the optical sensor unit 17 detects the deformity 13*a*1, the CPU 61 commands the timer 66 to initiate counting. After the travel time T4 has elapsed, the CPU commands the motor control circuit 64 to stop the rotation of the transfer belt 13. As a result, the transfer belt stops in a condition in which the deformity 13*a*1 lies on the second side S2 of the transfer belt.

As described above, in the second modification, the controller 60 detects the deformity 13*a*1 or 13*a*2 with the optical sensor unit 17, and stops the transfer belt 13 so that the detected deformity lies on the second side S2 where the transfer belt does not face the image-forming units 40K, 40Y, 40M and 40C. Therefore, in initiating the rotation of the transfer belt, the printer is capable of preventing a drive load caused by contact between the deformity and the photosensitive drums from increasing.

Second Embodiment

A printer and a transfer belt unit of a second embodiment have the same structure as the printer 1 and the transfer belt unit 10 of the first embodiment. In the second embodiment, however, the transfer belt 13 is made of a material that is less plastically deformable, or is resistant to curls, such as polyamide-imide resin (PAI).

Figure 14:
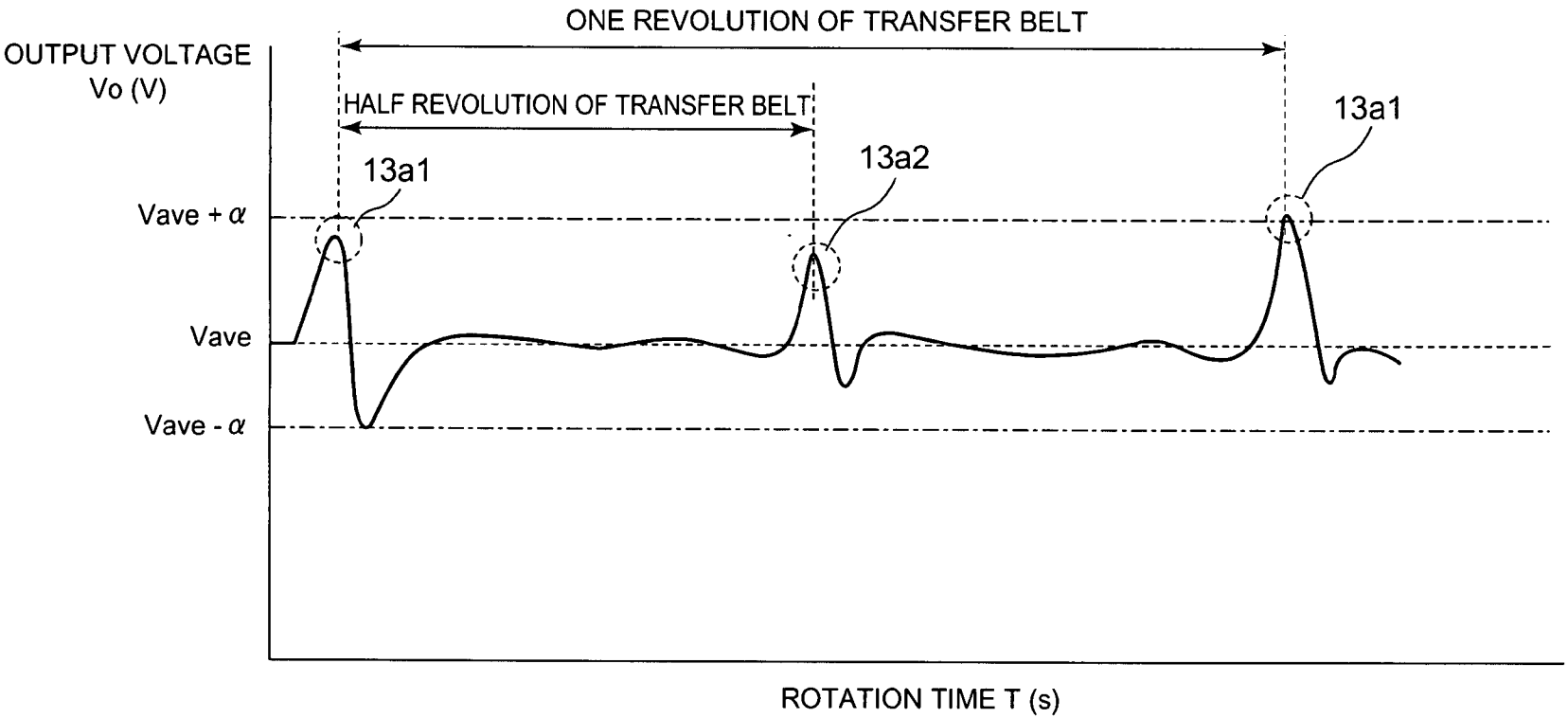
FIG. 14 is a waveform diagram of an output voltage signal from the second light-receiving element of the optical sensor unit of a second embodiment.
Figure 15:
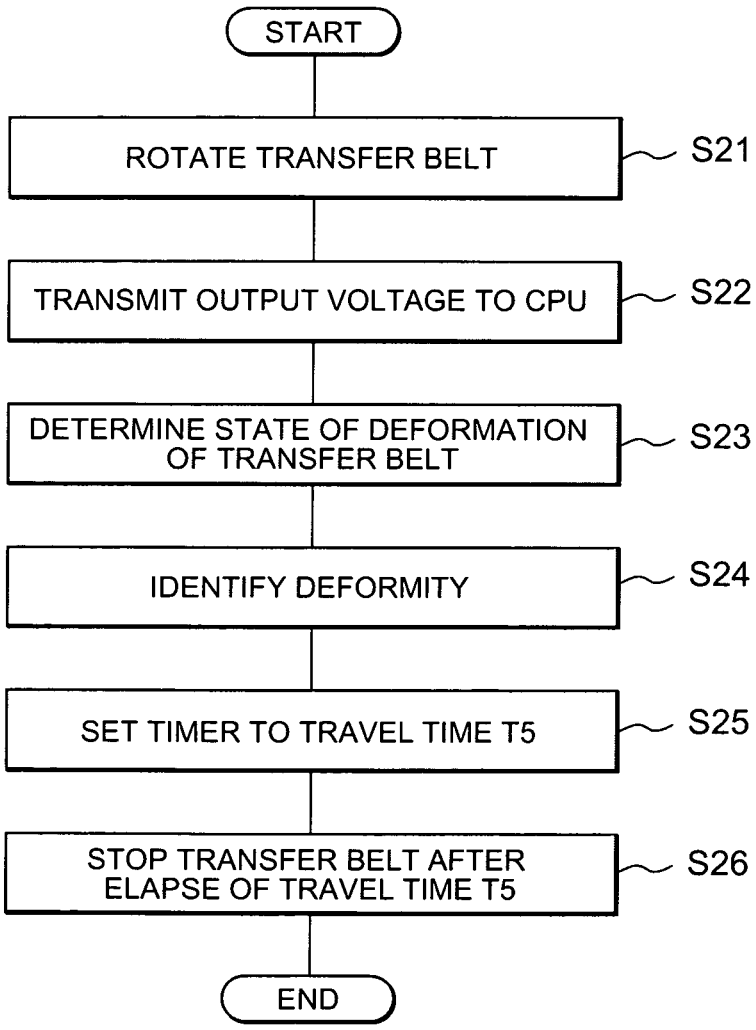
FIG. 15 is a flow chart of a stop control of the transfer belt in the printer of the second embodiment.

A stop control of the transfer belt 13 of the second embodiment will be described. FIG. 14 is a waveform diagram of an output voltage signal from the second light-receiving element 17*c* of the optical sensor unit 17 of the second embodiment. FIG. 15 is a flow chart of the stop control of the transfer belt in the printer of the second embodiment, which is performed by the CPU 61 according to the control programs stored in the ROM 62, as follows:

At S21, the motor control circuit 64 drives the drive motor 20 to rotate the drive roller 11 of the transfer belt unit 10, thereby rotating the transfer belt 13.

At S22, the light-emitting element 17*a* of the optical sensor unit 17 directs light toward the transfer belt 13. The second light-receiving element 17*c* receives light reflected from the transfer belt. The optical sensor unit transmits an output voltage signal corresponding to the intensity of the reflected light to the CPU 61.

At S23, the CPU 61 determines the state of deformation of the transfer belt 13, based on the waveform of the output voltage signal in one revolution of the transfer belt in FIG. 14. Specifically, the CPU calculates the voltage difference ΔV between the output voltage Vo and the average value Vave, and determines the state of deformation, i.e., the amount of deformation of the transfer belt, based on the voltage difference ΔV.

At S24, the CPU 61 identifies the deformity 13*a*1 where the amount of deformation of the transfer belt 13 is at a maximum.

At S25, the CPU 61 sets the timer 66 to a travel time T5 in which the deformity 13*a*1 travels from a position opposed to the optical sensor unit 17 to the curved portion P2. The travel time T5 has been calculated in advance based on the distance between the position opposed to the optical sensor unit 17 and the curved portion P2, and the speed of rotation of the transfer belt 13.

At S26, when the optical sensor unit 17 detects the deformity 13*a*1, the CPU 61 commands the timer 66 to initiate counting. After the travel time T5 has elapsed, the CPU commands the motor control circuit 64 to stop the rotation of the transfer belt 13. As a result, the transfer belt stops in a condition in which the deformity 13*a*1 lies at the curved portion P2.

Alternatively, at S25 and S26, the transfer belt 13 may be stopped in a condition where the deformity 13*a*1 lies at the curved portion P1. In this case, the CPU 61 sets the timer 66 to a travel time T6 in which the deformity 13*a*1 travels from the position opposed to the optical sensor unit 17 to the curved portion P1. When the optical sensor unit detects the deformity 13*a*1, the CPU commands the timer to initiate counting. After the travel time T6 has elapsed, the CPU commands the motor control circuit 64 to stop the rotation of the transfer belt.

As described above, in the second embodiment, the transfer belt 13 is made of a material that is less plastically deformable, and the controller 60 stops the transfer belt so that the deformity 13*a*1 or 13*a*2 lies at the curved portion P1 or P2. Therefore, the printer is capable of preventing deformities other than the deformities 13*a*1 and 13*a*2 from occurring on the transfer belt, and is also capable of reducing each of the deformities 13*a*1 and 13*a*2. Thereby, the smooth portion 13*b* of the transfer belt can be increased, so as to enhance the detection accuracy of the optical sensor unit 17.

While each of the embodiments has been described with respect to a transfer belt unit, the invention may be applicable to a belt-type fixing unit. In addition, while each of the embodiments has been described with respect to a tandem electrophotographic color printer, the invention may be applicable to a monochrome printer, a copier, a facsimile machine or a multifunction peripheral (MFP).

The belt drive device and the image forming apparatus being thus described, it will be apparent that the same may be varied in many ways. Such variations are not to be regarded as a departure from the spirit and scope of the invention, and all such modifications as would be apparent to one of ordinary skill in the art are intended to be included within the scope of the following claims.

What is claimed is:

1. A belt drive device incorporated in an image forming apparatus that has an image-forming unit, comprising:

a belt;

a roller that entrains the belt;

a roller drive member that drives the roller;

a state detector that detects a state of the belt;

a controller that identifies a specific portion of the belt based on the state detected by the state detector, and controls the roller drive member to stop the belt so that the specific portion lies at a predetermined position;

a light-emitting element that directs light toward the belt; and a light-receiving element that receives light reflected from the belt, and outputs an output voltage corresponding to the intensity of the reflected light, wherein the controller calculates an average value of the output voltage, and identifies the specific portion as a portion of the belt where the output voltage is closest to the average value, and controls the roller drive member to stop the belt so that the specific portion lies at a curved portion of the roller in contact with the belt.

2. An image forming apparatus, comprising:

an image-forming unit that forms an image on a recording medium;

a belt that transports the recording medium;

a roller that entrains the belt;

a roller drive member that drives the roller;

a state detector that detects a state of the belt;

a controller that identifies a specific portion of the belt based on the state detected by the state detector, and controls the roller drive member to stop the belt so that the specific portion lies at a predetermined position;

a light-emitting element that directs light toward the belt; and a light-receiving element that receives light reflected from the belt, and outputs an output voltage corresponding to the intensity of the reflected light, wherein the controller calculates an average value of the output voltage, and identifies the specific portion as a portion of the belt where the output voltage is closest to the average value, and controls the roller drive member to stop the belt so that the specific portion lies at a curved portion of the roller in contact with the belt.

* * * * *